US008266723B2

(12) United States Patent
Frandsen et al.

(10) Patent No.: US 8,266,723 B2
(45) Date of Patent: Sep. 18, 2012

(54) METHOD AND APPARATUS FOR ACCOMMODATING AND COVERING OF VARYING ABDOMEN

(76) Inventors: Liliana Frandsen, Roy, UT (US); Jennifer Frandsen, Orem, UT (US); Wendy DeBoer, Roy, UT (US); Brenda Schenck, Uintah, UT (US)

( * ) Notice: Subject to any disclaimer, the term of this patent is extended or adjusted under 35 U.S.C. 154(b) by 153 days.

(21) Appl. No.: 12/657,538

(22) Filed: Jan. 22, 2010

(65) Prior Publication Data

US 2010/0235965 A1 Sep. 23, 2010

Related U.S. Application Data

(60) Provisional application No. 61/162,461, filed on Mar. 23, 2009.

(51) Int. Cl.
*A41D 1/20* (2006.01)

(52) U.S. Cl. ..... 2/311; 2/338; 2/237

(58) Field of Classification Search ..... 2/311, 312, 2/338, 237, 236, 219, 220, 221, 266, 235, 2/318, 319, 323, 336, 211, 46, 47, 48, 51, 2/52, 69, 464, 76, 107, 109, 110, 112; 450/110, 450/120, 122, 123, 129, 155; D2/627, 853
See application file for complete search history.

(56) References Cited

U.S. PATENT DOCUMENTS

| | | | | | |
|---|---|---|---|---|---|
| 1,022,410 | A * | 4/1912 | Freedman | 2/221 |
| 1,174,976 | A * | 3/1916 | Gaines | 2/221 |
| 1,421,690 | A * | 7/1922 | Howard | 2/321 |
| 1,773,456 | A * | 8/1930 | Good | 2/85 |
| 2,544,333 | A * | 3/1951 | Lembo | 2/221 |
| 2,550,309 | A * | 4/1951 | Stancombe | 428/99 |
| 2,912,698 | A * | 11/1959 | Greenblatt | 2/211 |
| 3,793,645 | A * | 2/1974 | Kadison | 2/221 |
| 4,580,298 | A * | 4/1986 | Tuisl | 2/237 |
| 4,803,740 | A * | 2/1989 | Dawson | 2/215 |
| 6,219,848 | B1 * | 4/2001 | Russell | 2/221 |
| 7,181,775 | B2 * | 2/2007 | Carney | 2/311 |
| D619,780 | S * | 7/2010 | Hooker et al. | D2/627 |
| D637,795 | S * | 5/2011 | Hooker et al. | D2/853 |
| 2004/0049834 | A1 * | 3/2004 | Stangle et al. | 2/338 |
| 2004/0163159 | A1 * | 8/2004 | Edwards et al. | 2/338 |
| 2011/0314593 | A1 * | 12/2011 | Anderson | 2/338 |

* cited by examiner

*Primary Examiner* — Amy Vanatta

(57) ABSTRACT

A method and apparatus for accommodating and covering a varying sized abdomen and particularly the abdomen of a pregnant woman involving leaving a zipper opening of pants not intended to cover an enlarged girth at least partially open and using a garment to cover the opening in said pants by first interconnecting a pants button on one side of the opening to a buttonhole on the other side of the opening using a buttonhole elastic having elongate spaced slots as buttonholes and a double button to snugly secure the waistband of the non-maternity pants around a user's abdomen and using a flexible fabric garment to cover the zipper opening and, if desired, other selected portions of the abdomen of the user.

5 Claims, 8 Drawing Sheets

METHOD AND APPARATUS FOR ACCOMMODATING AND COVERING OF VARYING ABDOMEN

CROSS-REFERENCE TO RELATED APPLICATIONS

Figure 1:
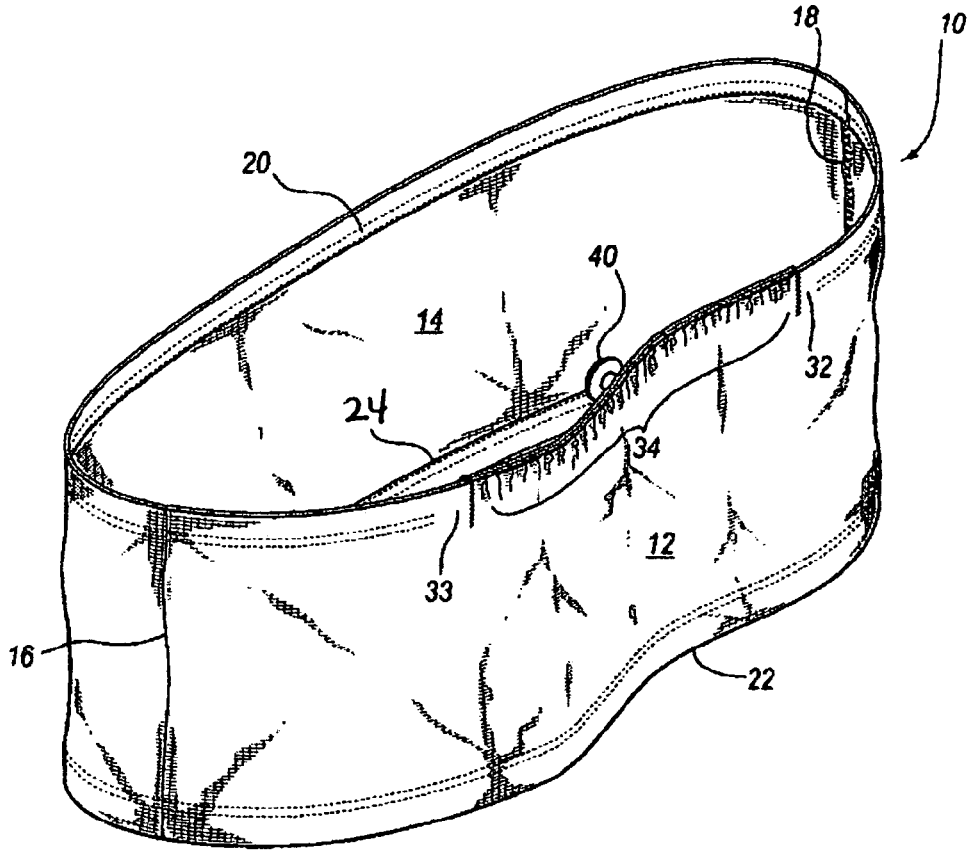

The present utility patent utility patent application claims the priority and benefit of U.S. provisional application 61/162,461, filed on Mar. 23, 2009 which is hereby incorporated by reference in its entirety.

STATEMENT REGARDING FEDERALLY SPONSORED RESEARCH OR DEVELOPMENT

Not Applicable.

REFERENCE TO MICROFICHE APPENDIX

Not Applicable.

BACKGROUND OF THE INVENTION

Field of the Invention

This invention relates to methods and apparatus used in accommodating and covering abdomens of people that are having abdomen size changes from time-to-time.

It is more particularly concerned with providing a garment that will accommodate the expansion of the abdomen of a pregnant woman and will provide a cover for her expanding abdomen.

It will become apparent that such accommodation and covering garment, worn in conjunction with conventional non-maternity pants during the time that a pregnant woman's abdomen is expanding can also be used after the birth of the child to again cover the abdomen until the abdomen returns to a smaller size and can be accommodated by non-maternity pants, i.e., denim jeans, cotton blend pants or pants of other suitable material used in conventional fashion.

As a pregnant woman moves into her pregnancy she often finds it difficult to have proper sized pants that she can wear. As her abdomen increases she generally has to acquire new pants that will accommodate the increased girth. For some period of time a woman may be able to wear non-maternity pants made with waistbands having limited stretch. However, eventually the time comes that she can no longer button the waistband of her non-maternity pants. However, some women frequently prefer being able to wear their normal, non-maternity pants well into at least some period of pregnancy as their abdomen is becoming enlarged. This is often because of the expense involved in purchasing maternity clothing and often because women prefer the style of non-maternity pants.

The present invention provides an article of clothing that can be worn to extend the time period into a pregnancy during which non-maternity pants can be worn. The article of clothing of the present invention can also be worn after pregnancy to enable a woman to get back to wearing her non-maternity pants, at the earliest possible time.

It will be apparent, that the article of clothing of the present invention can significantly reduce the amount of money necessary to purchase non-maternity pants of differing waist sizes, or to purchase specialty, pregnancy pants that will stretch to accommodate an abdomen of changing size. In the past, it has not been uncommon for women in the early stages of pregnancy to release the button that fastens the waistband of her normal non-maternity pants and to use a large safety pin, or other similar device, to hold the open waistband together around her enlarged girth. Generally, a woman holding the open waistband together with a device such as a safety pin then wears a loose over blouse that will hang down below the connecting safety pin or other device, so that it will not be visible to persons looking at the woman. Using such safety pin or other similar device effectively lengthens the span of the normal non-maternity pants and provides a way to continue use of such non-maternity pants into early stages of pregnancy and again after pregnancy before the non-maternity pants can be worn in a normal fashion. However, the use of a safety pin or similar device, allows a user to extend the life of the wear ability of the non-maternity pants only for a period of time dependent upon the length of the safety pin or similar device. In addition, it is difficult to use a safety pin to hold the waistband sufficiently tight to hold the pants up while still providing comfort to the user.

There remains a need for an article of clothing that can be comfortably and reliably used with non-maternity pants well into and immediately after a pregnancy. There also remains a need for such an article of clothing that is fashionable and that can be used with many different non-maternity pants and with many different kinds of blouses, shirts or other tops.

BRIEF SUMMARY OF THE INVENTION

Objects of the Invention

Principal objects of the present invention are to provide an article of clothing that can be inexpensive, and usable with existing non-maternity pants for an extended period of a pregnancy, or for use soon after the pregnancy and for an extended period of time until the user has achieved a sufficiently smaller girth to again wear non-maternity pants in a normal fashion.

Still other objects of the invention are to provide an article of clothing to be used with non-maternity pants that is both easy to wear, and fashionable.

Still other objects of the invention are to provide an article of clothing that will be comfortable to wear and that can be produced and marketed for a considerably lower cost than is involved in buying a series of large sized non-maternity pants and/or increasingly large waisted, or stretchable waist maternity pants.

Other objects of the invention are to provide an article of clothing that is simple to use and that will cover any gap provided in a zippered or buttoned fly opening that is left at least partially open, along with the release of the waist button of non-maternity pants.

Still other objects of the invention are to provide articles of clothing that will accommodate and cover expanding girth of a pregnant woman who is wearing non-maternity pants and that will cover an enlarged girth both above and below the waist area of the woman wearing such garment.

Features of the Invention

Principal features of the invention include front and rear panels of a suitable fabric material. The front and back panels are sewn together to form an encircling or tubular body garment that will cover at least a portion of the abdomen of a user. The panels are sewn together at side edges and the composite panels are hemmed at the tops and bottoms.

A waistband is formed in the front panel and the waistband includes an elastic strip, hereinafter a "buttonhole elastic" sewn to the front panel and with the front panel material secured to the elastic strip being gathered before being sewn to the elastic strip. Thus, when the elastic strip is stretched the panel material sewn to it will also expand. The elongate elastic strip has a series of aligned slots serving as buttonholes, spaced there along, from one end to the other end.

The waistband may be positioned at the top of the interconnected back panels, in which case the front and back panels will depend from the waistband when the garment is in use. Alternatively, the waistband may be located intermediate the length of the front and back panels, in which case the front and back panels will extend both upwardly from the waistband, and downwardly below the waistband.

The buttonhole elastic may have its top edge sewn to the top edge of the front panel for the entire length of the elastic member. In this case the garment will extend downwardly outside the wearers non-maternity pants. Alternatively, only a portion of the length of the buttonhole elastic is sewn to the front panel. In this case the garment may be worn inside the user's non-maternity pants.

Other principal features of the invention include spaced slots through the buttonhole elastic and a double button having a pair of buttons interconnected by a connector member such that one button can be inserted through a buttonhole in the waistband of non-maternity pants and with the other button being inserted through a selected slot in the buttonhole elastic.

Additional objects and features of the invention will become apparent from the following drawings and detailed description.

BRIEF DESCRIPTION OF THE FIGURES OF THE INVENTION

Figure 2:
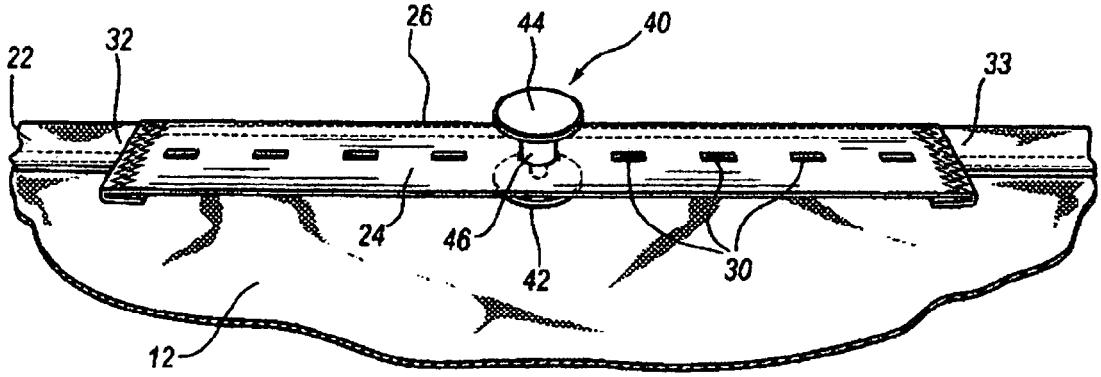
Figure 3:
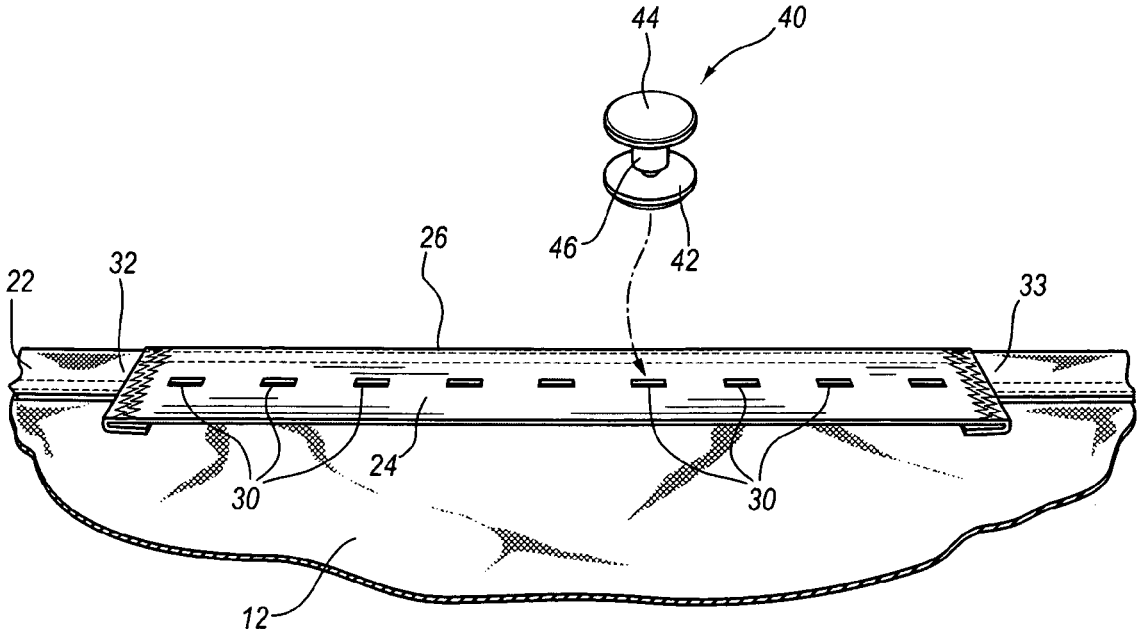
Figure 4:
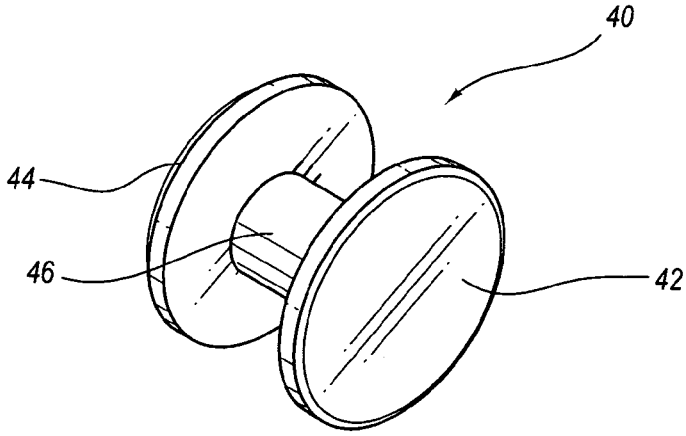
Figure 5A:
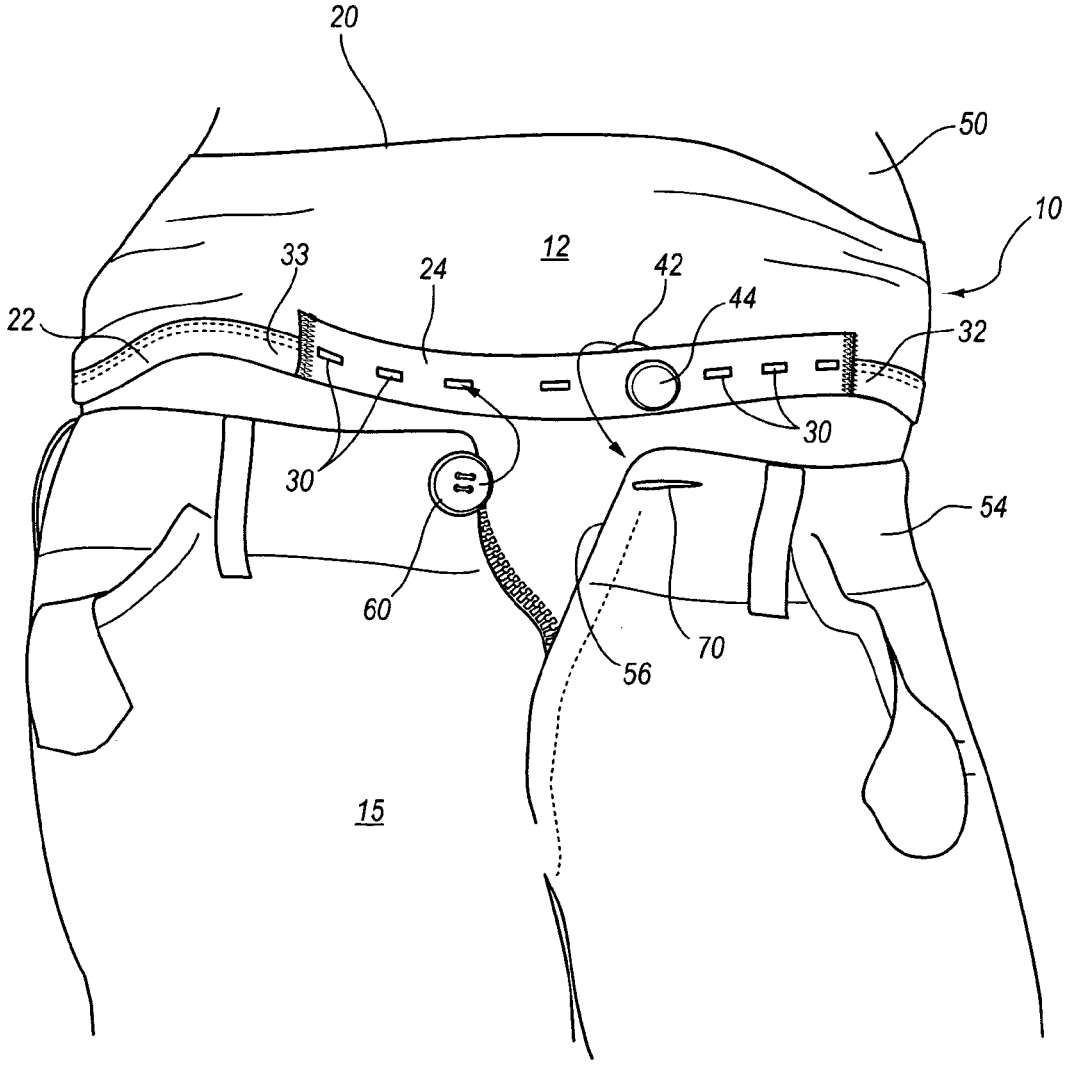
Figure 5B:
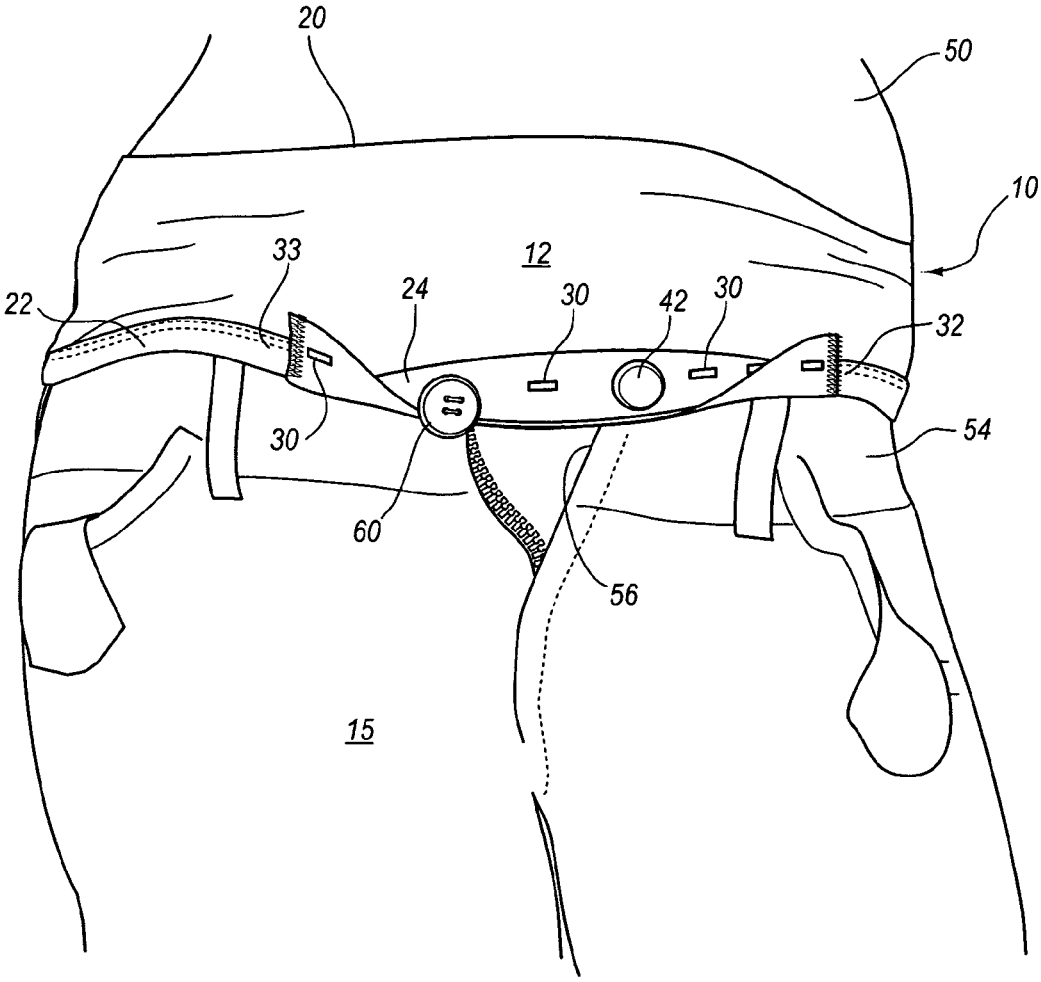
Figure 5C:
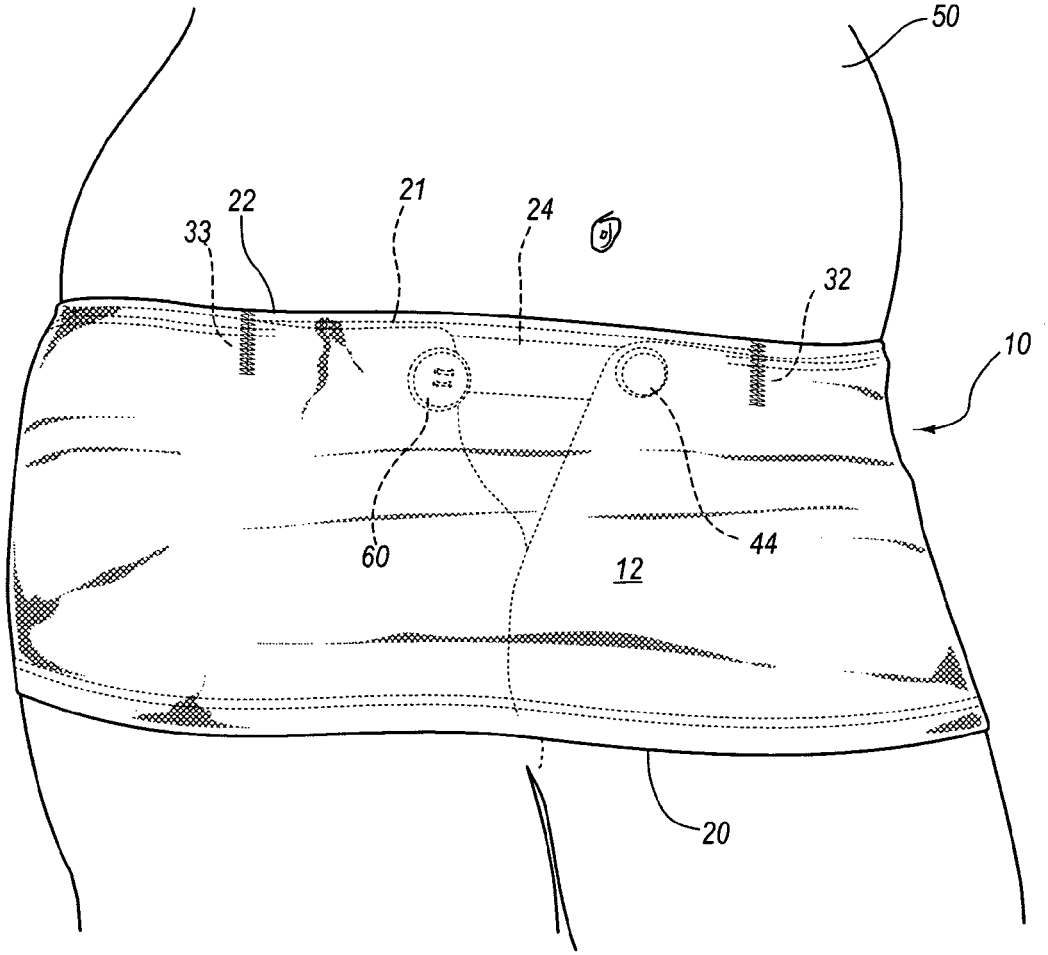
Figure 6:
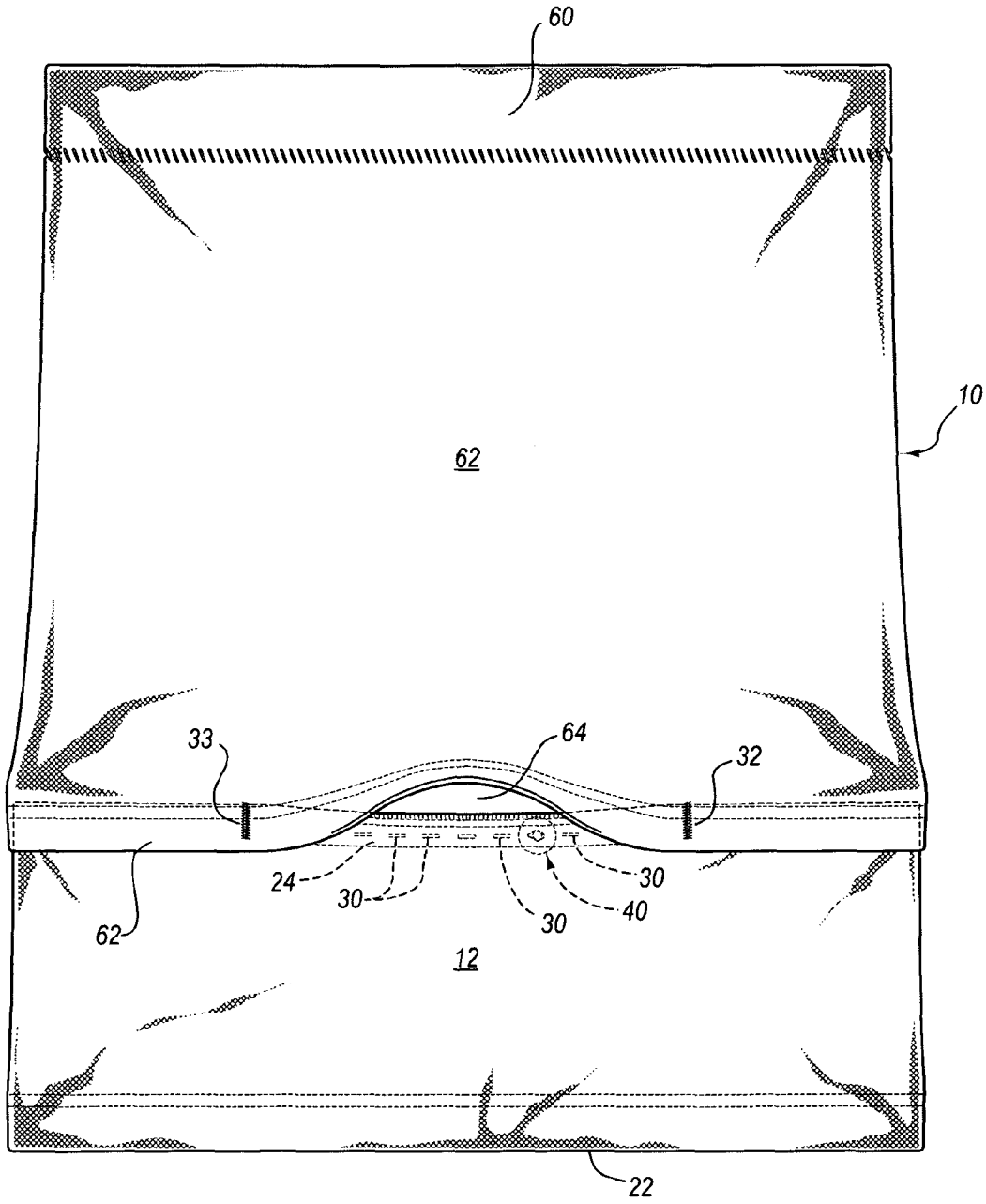
Figure 7:
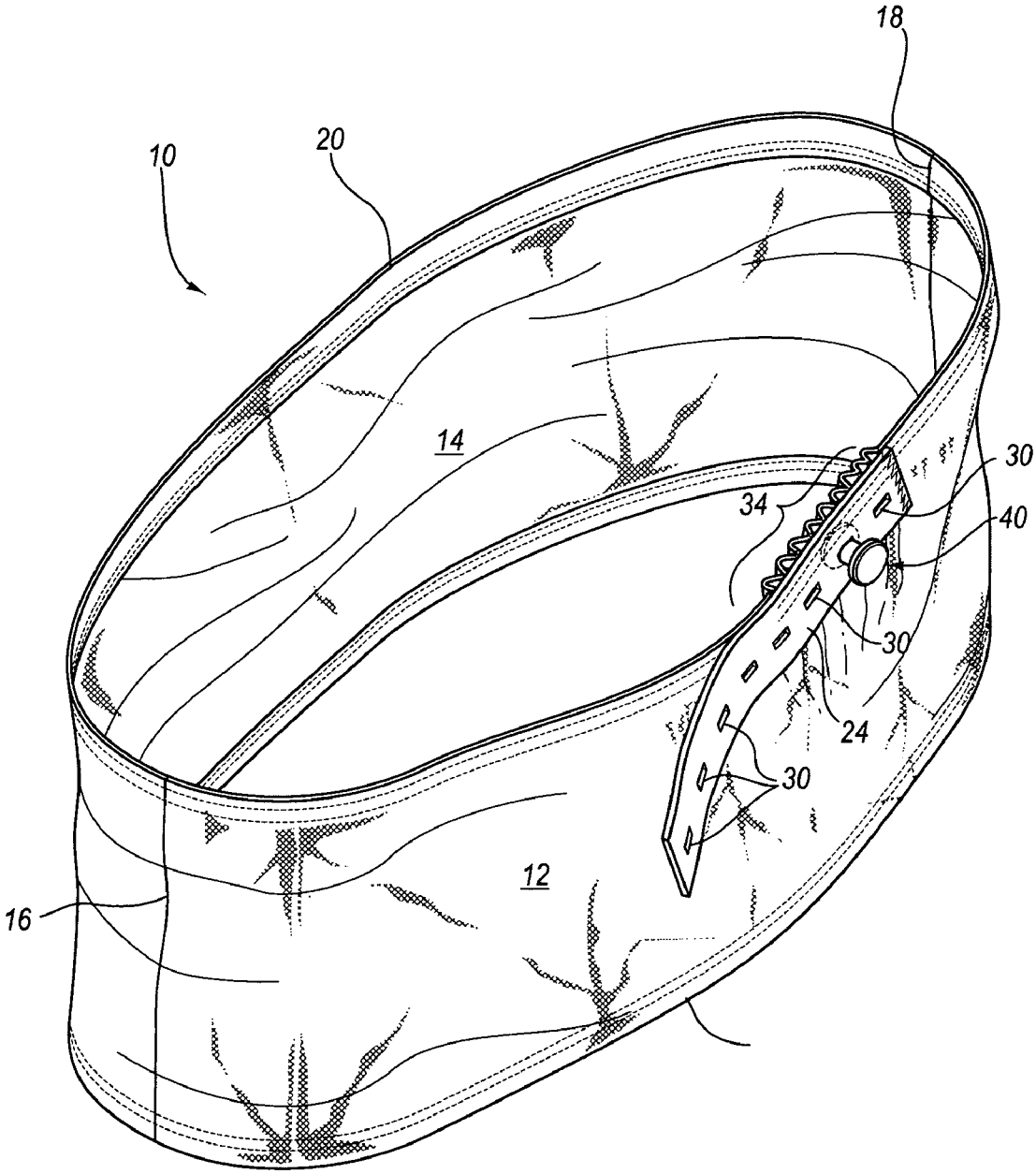
Figure 8:
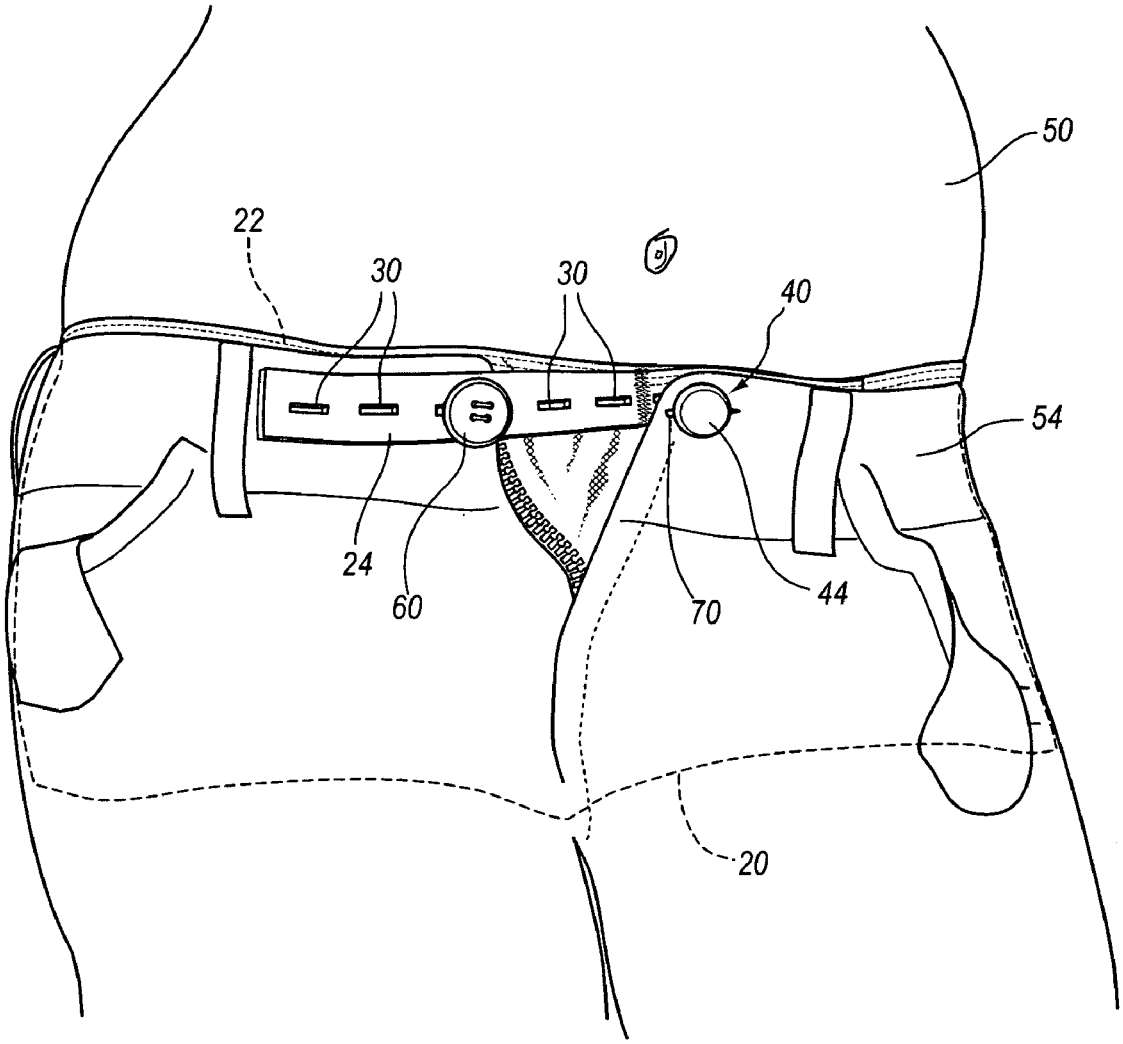

In the Drawings:

FIG. 1 is a perspective view taken from above and one side of a garment of the invention;

FIG. 2, an enlarged perspective view of the elastic member, i.e., "buttonhole elastic" of the waistband of the invention with a double button and showing a fragmentary portion of a downturned front panel of the garment of the invention;

FIG. 3, a view like that of FIG. 2, but showing the double-button of the invention removed from the buttonhole elastic;

FIG. 4, a still greater enlarged view showing the double button of the invention;

FIG. 5A, a perspective view showing the waistband of the garment of the invention shown in FIG. 1 and attachment of said waistband to the waistband of non-maternity pants;

FIG. 5B, a figure like that of FIG. 5A but showing the buttonhole elastic secured by a double button and showing the existing button on non-maternity pants;

FIG. 5C, a view like that of FIGS. 5A and 5B, but showing the front panel of the garment shown in FIG. 1, on a pregnant woman;

FIG. 6, a front elevation view showing a garment of the invention with a waistband positioned to have a portion of the garment extending below the garment waistband and a portion of the garment extending above the waistband;

FIG. 7, a view like that of FIG. 3, but showing the buttonhole elastic with a top edge sewn to only one end portion of the front panel and with a freely projecting opposite end of the buttonhole elastic; and FIG. 8, a view like that of FIG. 5A, but showing the buttonhole elastic attached as shown in FIG. 7.

DETAILED DESCRIPTION

Referring Now to the Drawings

In the preferred embodiment of the invention illustrated in FIGS. 1-5C, a garment, shown generally at 10, is provided that will accommodate and cover a portion of a varying size abdomen. Garment 10 includes a front panel 12 and a rear panel 14, with the panel ends sewn together at 16 and 18. Panels 12 and 14 are each preferably made of suitable fabric material. A material which comprises 90% cotton and 10% spandex has been found to be very suitable, for example. Such material provides stretch and will loosely conform to any portion of a user's abdomen that is encircled by the connected panels.

A hem 20 is formed at the interconnected tops of the panels 12 and 14 and a similar hem 22 is formed at the bottom of the interconnected panels. A length of elastic material 24, hereinafter referred to as the "buttonhole elastic" is attached to an upper edge of the fabric panel 12 and extends between spaced apart ends 32 and 33 of hem 20, which ends are located at the front of the garment 10. The buttonhole elastic strip is sewn at its top edge 26 to the top edge of gathered section 34 of panel 12. Buttonhole elastic 24 has a series of spaced apart slots 30 and the slots extend from one end of the buttonhole elastic, in a line, to the other end of the buttonhole elastic.

A "double button" 40 comprises a pair of buttons 42 and 44 interconnected back-to-back by a connector member 46. The connector member 46 has a smaller outside circumference than does either of the buttons 42 and 44. As shown in FIG. 5A, the garment 10 is positioned to extend around a portion of the abdomen of a woman shown fragmentarily at 50. As shown, the woman 50 is wearing non-maternity pants 52 having a waistband 54. As shown, the non-maternity pants 52 are provided with a zipper 58 that is intended to be used to close the opening and with a button 60 that is intended to be inserted through a buttonhole 70 on the other side of the opening 56. As shown, the abdomen of the woman 50 is too large to allow button 60 to be inserted through button hole 70 and zipper 58 to be fully moved upwardly to close the opening 56. Article 10 may be used to close the waistband 54 snugly around the abdomen of the woman 50 and the article 10 can also be used to cover the opening 56.

As shown in FIG. 5A, the front panel 12 of article 10 is turned inside out as it surrounds the abdomen of the woman 50. While the panel 12 is in this position, the button 60 of the pants 52 can be inserted through a selected slot 30 in the buttonhole elastic 24. At the same time the buttonhole elastic is stretched lightly and the button 42 is inserted through the buttonhole 70 in the waistband 54 of the pants 52. Thereafter, the panel 12 and the panel 14 connected thereto are pulled down over the waistband 54 so that panel 12 will cover the opening 56, as shown in FIG. 5C.

In the embodiment of the invention shown in FIG. 6, the clothing article 10 includes a front panel 12 and a rear panel 14, the same as in shown in the embodiment of FIGS. 1-5C. In the embodiment of FIG. 6, the clothing article 10 includes a front panel 12 and a rear panel 14. However, article 10, in FIG. 6, in addition to having a top hem 20 and a bottom hem 22, both of which extend fully around the sewn together panels 12 and 14, further include an intermediary hem 62. The intermediary hem 62 includes the spaced apart ends 33 and 32 and has the buttonhole elastic 24 extending between the ends 33 and 32 in the manner previously disclosed in connection with the embodiment of FIGS. 1-5. In this embodiment the panel 12 not only extends downwardly from the hem 60 to cover a gap, as shown at 56 and FIGS. 5A and 5B, but also includes a portion extending upwardly from the buttonhole elastic 24 to encompass a portion of the user's abdomen above the buttonhole elastic 24 and below the breast line of the user.

The clothing article 10 shown in FIGS. 1-5C or in FIG. 6, can be worn by a user with the panel 12 extending outside of the non-maternity pants with which the clothing article 10 is being used. The opening 56 is fully covered and a user can also wear an outer blouse or top that will provide a layered look to the clothing of the user.

In the embodiment shown in FIGS. 7 and 8, the clothing article 10 includes a front panel 12 connected at 16 and 17 to a rear panel 14. In this embodiment, the button 44 of the double button 40 is inserted from inside the pants through the hole 70 of the waistband 54 of non-maternity pants 20. The unattached end of buttonhole elastic 24 exits the zipper fly opening, is stretched and receives the button 60 of the non-maternity pants. The front panel 12 then extends downwardly, inside the non-maternity pants, as shown by dotted lines and hem 20. The fly opening is thus covered inside the pants by the panel 12.

Although preferred embodiments of our invention have been herein described, it is to be understood that the present disclosure is by way of example and that variations are possible without departing from the subject matter coming within the allowable scope of the following claims, which subject matter we regard as our invention.

We claim:

1. A method of accommodating and covering a portion of a variably sized abdomen comprising the steps of:

(a) opening a waistband of a pair of pants by releasing a button at the top of one side of a closable pants opening from a buttonhole at the other side of the top of said closable pants opening;

(b) positioning the spaced apart button and buttonhole through the pants in a desired spaced relationship;

(c) attaching a buttonhole elastic having a buttonhole positioning the button of the pants through said buttonhole of the buttonhole elastic;

(d) stretching the buttonhole elastic to align another hole therethrough with the buttonhole of the pants;

(e) securing the stretched buttonhole elastic to the pants by inserting a button of a double button through each of said aligned holes; and (f) positioning a fabric covering which attaches to and extends from said buttonhole elastic to encircle a desired portion of the abdomen.

2. An article of clothing to be used to accommodate and cover a varying sized abdomen comprising flexible fabric panels interconnected to form an encircling member;

a hem formed around said encircling member;

a buttonhole elastic strip attached to the hem and having a series of buttonholes spaced therealong; and a double button having first and second buttons interconnected in back-to-back relationship by a connector having an outside circumference smaller than the circumference of each of said first and second buttons, and with one of said buttons inserted through one of said holes in said buttonhole elastic.

3. An article of clothing as in claim 2, wherein the hem is at a top edge of the encircling member; and an entire top edge of the buttonhole elastic is sewn to a gathered edge of a fabric panel along the full length of said buttonhole elastic.

4. An article of clothing as in claim 2, wherein the hem is positioned between a top edge and a bottom edge of the encircling member.

5. An article of clothing as in claim 2, wherein the buttonhole elastic strip has one end attached at a top edge to a gathered portion of a panel of the encircling member and an opposite end of the buttonhole elastic strip is unattached.

* * * * *